US006375015B1

(12) United States Patent
Wingate

(10) Patent No.: US 6,375,015 B1
(45) Date of Patent: Apr. 23, 2002

(54) SHELVING SYSTEM AND DISPLAY UNIT THEREFOR

(75) Inventor: Mark L. Wingate, Huntley, IL (US)

(73) Assignee: Chicago Show, Northfield, IL (US)

( * ) Notice: Subject to any disclaimer, the term of this patent is extended or adjusted under 35 U.S.C. 154(b) by 0 days.

(21) Appl. No.: 09/626,439

(22) Filed: Jul. 27, 2000

(51) Int. Cl.[7] ..... A47F 5/00

(52) U.S. Cl. ..... 211/59.3; 211/175; 211/90.02; 312/71

(58) Field of Search ..... 211/59.3, 59.2, 211/184, 175, 90.02; 312/45, 71

(56) References Cited

U.S. PATENT DOCUMENTS 4,762,236 A * 8/1988 Jackle et al. ..... 211/59.3
4,836,390 A * 6/1989 Polveve ..... 211/59.3
4,907,707 A * 3/1990 Crum ..... 211/59.3
5,012,936 A 5/1991 Crum
5,123,546 A * 6/1992 Crum ..... 211/59.3
5,638,963 A 6/1997 Finnelly et al.
5,673,801 A 10/1997 Markson
5,720,230 A 2/1998 Mansfield
5,730,320 A 3/1998 David
5,738,019 A * 4/1998 Parker ..... 211/175 X
5,855,283 A * 1/1999 Johnson ..... 211/59.3
6,164,462 A * 12/2000 Mumford ..... 211/90.02 X

* cited by examiner

*Primary Examiner*—Robert W. Gibson, Jr.
(74) *Attorney, Agent, or Firm*—Robert E. Browne; Michael A. Carrillo; Jeffrey G. Mote

(57) ABSTRACT

A display unit comprising a plurality of product trays connected to a plurality of shelves is disclosed. Each product tray includes a product slide moveable relative to the shelf and a facing slide moveably relative to both the product slide and the shelves. A restoring spring connects the product slide to the shelf and is positioned to facilitate restoration of the product slide from a stocking position to a displaying position. Locking mechanisms for both the product slide and the facing slide are also disclosed.

17 Claims, 3 Drawing Sheets

SHELVING SYSTEM AND DISPLAY UNIT THEREFOR

FIELD OF THE INVENTION

The present invention generally relates to shelving systems, and in particular, to display units.

BACKGROUND OF THE INVENTION

Shelving systems including display units are well known in the art. Problems associated with such systems are often well known in the art. Such problems include maintaining an aesthetic display and restocking the shelves. These problems have been addressed by generally two approaches. The first approach is to provide a shelf which may be pulled out from the support structure. Examples of this approach are taught in U.S. Pat. Nos. 5,673,801 and 5,720,230 which are incorporated herein by reference. Examples of the second approach generally comprise placing an assist member in the product container to push the products toward the front of the shelf, a process known as "facing." Examples of this approach are taught in U.S. Pat. Nos. 5,012,936; 5,638,963; and 5,730,320, which are incorporated herein by reference.

Pat. '936 discloses a product tray member that is slidably engaged with a track member so that the product tray member can be slid away from the track assembly. An upstanding product follower is slidably mounted onto the product tray member in a manner whereby the follower moves longitudinally within the product tray member. The product follower member is biased in a forward direction.

SUMMARY OF THE INVENTION

A display unit according to the present invention comprises a plurality of product trays. Each product tray comprises a product member for containing one or more products and a facing member for facing the one or more products contained in the product member. The product member is linearly movable relative to a shelf on which it is supported. The facing member is movably connected to the product member and linearly moveable relative to both the shelf and the product member. The display unit may be adapted for use with a shelving system.

In one embodiment, the display unit comprises a shelf adapted to cooperate with a shelving system. A plurality of product trays are supported on, and preferably attached to, the shelf. Each product tray comprises a product slide and a facing slide. The product slide is linearly movable relative to the shelf, and the facing slide slidably engages the product slide while being linearly movable relative to the shelf and the product slide.

Another embodiment of the invention is directed toward a shelving system. The shelving system comprises a support structure, including a plurality of shelves attached to the support structure, and a plurality of product trays connected to the shelves. Each product tray comprises a product slide moveable relative to the shelf and a facing slide moveable relative to both the product slide and the shelf. Preferably a restoring spring connects the product slide to the shelf and is positioned to facilitate restoration of the product slide from a stocking position to a displaying position.

An object of the present invention is to improve the aesthetic appearance of product displays as well as improve the efficiency with which such displays are managed.

Another object of the present invention is to provide a display unit which may be used to retrofit an existing shelving system.

A further object of the present invention is to provide a display unit particularly well suited for uniform products, such as aerosol canisters. Yet another objective is to provide such a shelf with a means for facilitating restocking. A more particular objective is to provide a display container with a restorative force for returning a fully loaded container to its display position. This unit having such a restorative force has the advantage of increasing labor efficiency and reducing damaged products due to movement of heavy containers of products or repetitive reshuffling of products.

Other objects and advantages in accordance with the present invention will be apparent to those of skill in the art from the teachings disclosed herein.

BRIEF DESCRIPTION OF THE DRAWINGS

In the interest of enabling one of skill in the art to practice the invention, exemplary embodiments are shown and described. For clarity, details apparent to those of skill in the art without undue experimentation are generally omitted from the drawings and description.

DESCRIPTION OF EXEMPLARY EMBODIMENTS

Figure 1:
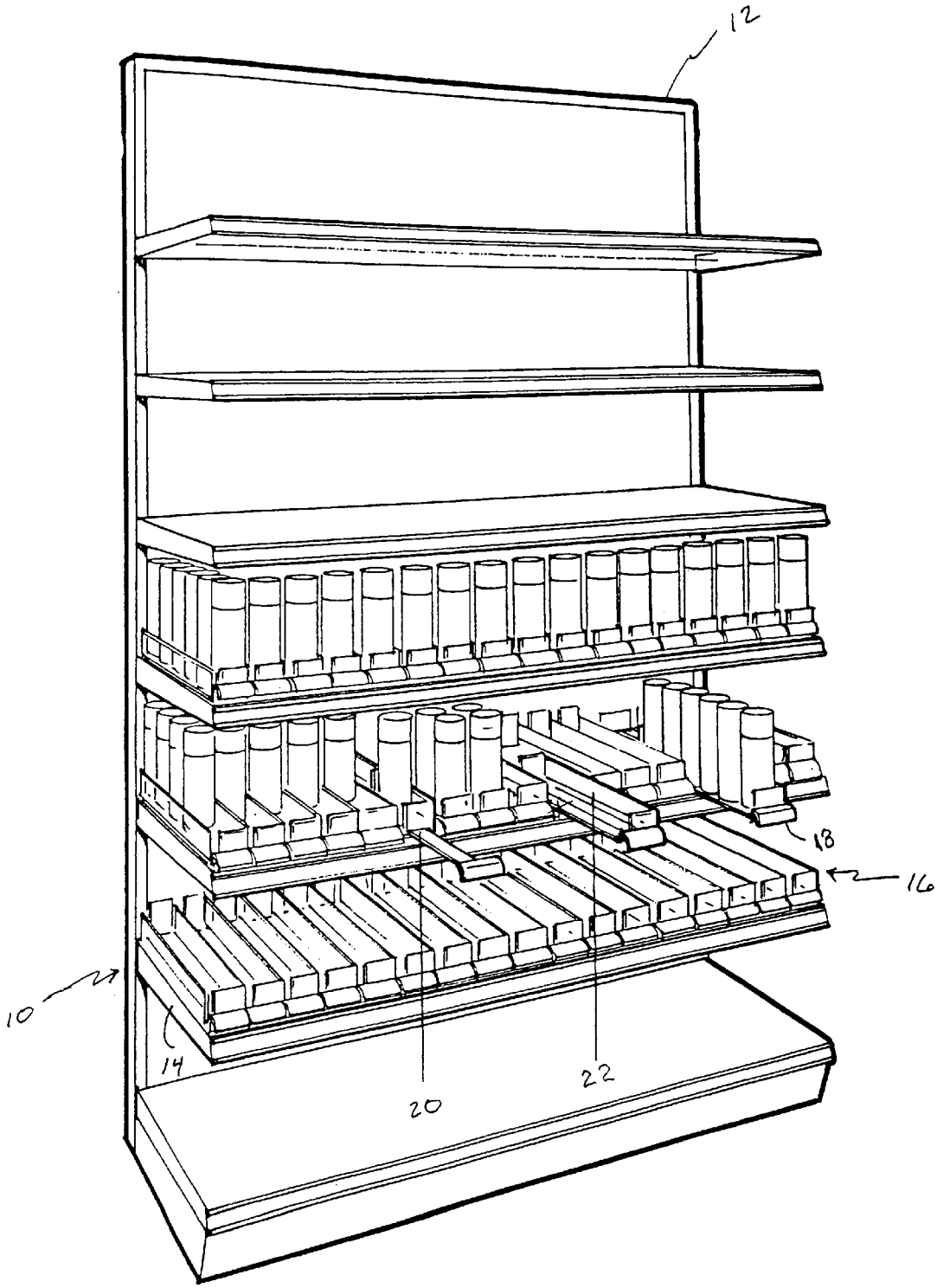
FIG. 1 shows a perspective view of a display unit according to the present invention.

The present invention is discussed in relation to display units for shelving systems, however, other uses will be apparent from the teachings disclosed herein. The present invention will be better understood from the following detailed description of exemplary embodiments with reference to the attached drawings, wherein like reference numerals and characters refer to like parts, and by reference to the following claims.

FIG. 1 depicts one embodiment of a display unit 10 according to the present invention. The display unit 10 is adapted for use with a shelving system 12. The display unit 10 includes a shelf 14 adapted to cooperate with the shelving system 12. A plurality of product trays 16 are supported by the shelf 14. Each product tray 16 comprises a product slide 18 and a facing slide 20. The product slide 18 is movable relative to the shelf 14. The facing slide slidingly engages the product slide 18 and is linearly movable relative to both the shelf 14 and the product slide 18. In one embodiment, the shelving system 12 comprises a gondola (not shown) generally comprising support rails for receiving a shelf. Accordingly, in one embodiment, the shelf 14 is adapted to removably connect to the gondola.

More generally the invention may be directed toward a shelving system comprising a display unit. Such a shelving system, according to the present invention, would generally comprise a plurality of display units as discussed above, and further described below.

Figure 2:
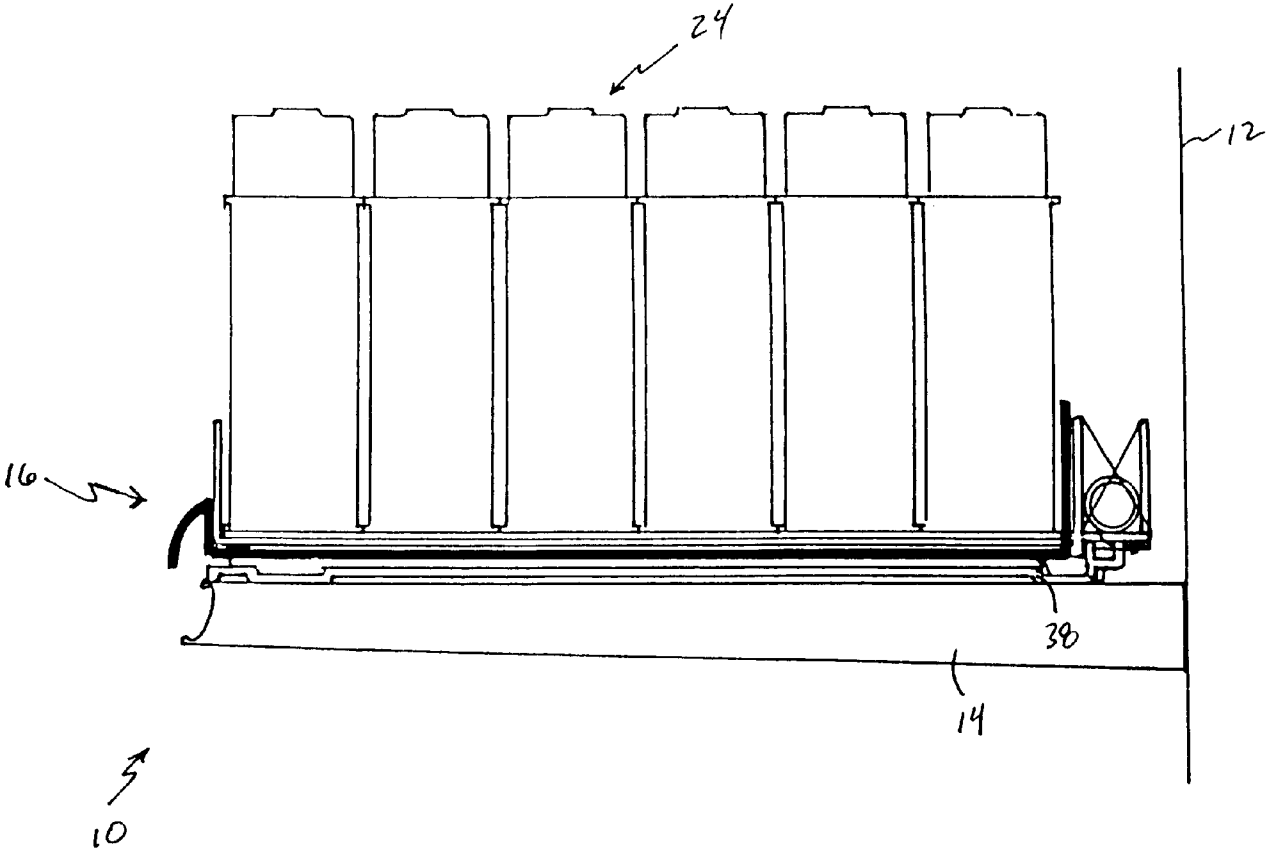
FIG. 2 shows a side view of a product tray of the display unit shown in FIG. 1.
Figure 3:
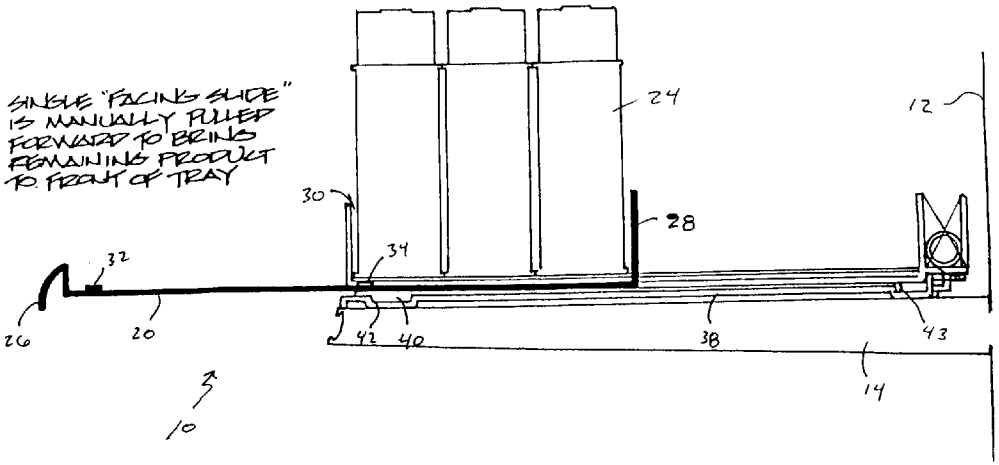
FIG. 3 depicts the product tray shown in FIG. 2 with the facing slide pulled forward to face products contained in the product tray. The side wall of the product tray is removed for clarity.
Figure 4:
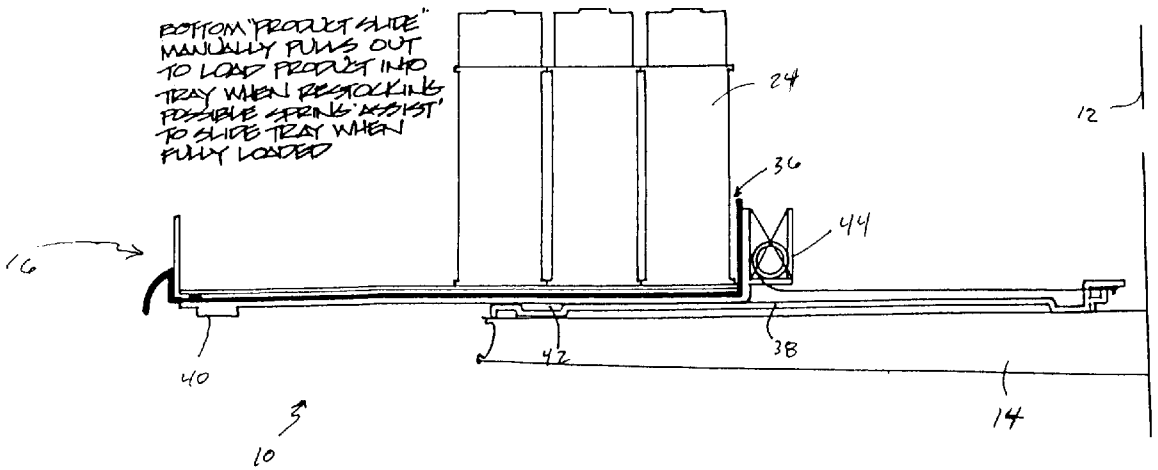
FIG. 4 shows the product tray of FIG. 2 with the product slide pulled forward to facilitate restocking.

FIGS. 2–4 show side views of the display unit 10 shown in FIG. 1. The sidewall 22 of the product tray 16 has been removed for clarity. The product tray 16 in FIG. 2 contains a plurality of products 24 and is shown in a display position, also referred to as a stowed position.

As products 24 are removed from the display tray 16, it becomes desirable to face (or pull forward), the remaining products in the product tray 16. FIG. 3 shows the facing slide 20 pulled forward to face the products 24. A store clerk (e.g., employee) need merely pull the pull member 26, which is connected to the push member 28, forward. The push member 28, which extends into the product tray 16, pushes the products 24 toward the front 30 of the product tray 16. In a preferred embodiment, the facing slide 20 comprises a facing slide lip 32 adapted to cooperate with recess 34 in the bottom of the product slide 18 to form a locking mechanism. To disengage the locking mechanism the clerk pushes down on the pull member 26 and linearly advances the pull member away from the rear of the shelving system 12.

As products 24 are sold, or after the product tray 16 is empty, it is desirable to restock the products. To facilitate restocking the product tray 16 is adapted to be pulled forward to provide access to the rear 36 of the product tray. This restocking position is shown in FIG. 4. In the embodiment shown in FIGS. 2 through 4, the product tray 16 slidingly engages a runner 38, preferably, affixed to the shelf 14. In a preferred embodiment, the product tray 16 comprises a lip 40 adapted to cooperate with a recess 42 in the runner 38. To facilitate restoring a full, or loaded, product tray 16 to its display position (as shown in FIG. 2), restoring spring can be used to connect the product tray 16 to the shelf 14. In one preferred embodiment, the restoring spring 44 connects the rear 36 of the product tray 16 to the runner 38 near the rear of the shelf 14. A second lip 43 (best seen in FIG. 3) is positioned to engage recess 40 when the product slide 16 is fully extended for stocking. The second lip 43 reduces (and preferably prevents) the tenancy of the product slide to return to the stowed position inadvertently.

While the above embodiment has been described with respect to "sliding" structure, it will be understood that the invention may more generally comprise product members and facing members. Further other means for providing movable contact between and among the members will be apparent to those of skill in the art. Additionally, the invention may comprise a display unit adapted to merely rest on a shelf, as well as be affixed thereto.

While the invention has been particularly shown and described with reference to particular embodiments thereof, it will be understood by those skilled in the art through various changes in form and detail maybe made therein without departing from the spirit and scope of the invention. The scope of the claimed invention is intended to be defined by the following claims as they would be understood by one of ordinary skill in the art with appropriate reference to the specification, including the drawings as warranted.

What is claimed is:

1. A display unit comprising:

a product member for containing one or more products, wherein the product member is linearly moveable relative to a shelf;

a facing member for facing the one or more products contained in the product member, wherein the facing member is moveably connected to the product member and linearly moveable relative to both the shelf and the product member, and a restoring spring connected to the product member for facilitating return of the product member from a stocking position to a displaying position.

2. The unit of claim 1, comprising a plurality of product members, including the product member, wherein the product members are arranged horizontally relative to one and another.

3. The unit of claim 1, wherein the restoring spring is connected to the rear of the product member.

4. A display unit comprising:

a product member for containing one or more products, wherein the product member is linearly moveable relative to a shelf;

a facing member for facing the one or more products contained in the product member, wherein the facing member is moveably connected to the product member and linearly moveable relative to both the shelf and the product member; and a facing member locking mechanism comprising first and second members for locking the facing member in a set position relative to the product member while allowing the product member to be linearly movable relative to the shelf, wherein the facing member comprises the first facing member locking mechanism member; and the product member comprises the second facing member locking mechanism member.

5. The display unit of claim 4, comprising:

a runner movably connected to the product member and stationary relative to the shelf, a product member locking mechanism connected to the product member for locking the product member relative the runner in both displaying and stocking positions.

6. A display unit comprising:

a product member for containing one or more products, wherein the product member is linearly moveable relative to a shelf; and a facing member for facing the one or more products contained in the product member, wherein the facing member is moveably connected to the product member and linearly moveable relative to both the shelf and the product member, and comprises:

a push member projecting into the product member; and a pull member accessible from outside of the product member, wherein the pull member is connected to the push member, whereby pulling the pull member results in pushing a product in the product member with the push member.

7. A display unit for use with a shelving system, the unit comprising:

a shelf adapted to cooperate with the shelving system; and a plurality of product trays supported by the shelf, each product tray comprising:

a product slide linearly moveable relative to the shelf; and a facing slide slidingly engaging the product slide and linearly moveable relative to the shelf and the product slide, wherein each facing slide comprises:

a push member projecting into the respective product member; and a pull member accessible from outside of the respective product member, wherein the pull member is connected to the push member, whereby pulling the pull member results in pushing a product in the product member with the push member.

8. The unit of claim 7, wherein the shelf is adapted to removably connect to a gondola.

9. A display unit for use with a shelving system, the unit comprising:

a shelf adapted to cooperate with the shelving system; and a plurality of product trays supported by the shelf, each product tray comprising:

a product slide linearly moveable relative to the shelf, a facing slide slidingly engaging the product slide and linearly moveable relative to the shelf and the product slide; and a restoring spring connecting the product slide to the shelf, wherein the spring is positioned to facilitate return of the product slide from a stocking position to a displaying position.

10. A display unit for use with a shelving system, the unit comprising:

a shelf adapted to cooperate with the shelving system; and a plurality of product trays supported by the shelf, each product tray comprising:

a product slide linearly moveable relative to the shelf a facing slide slidingly engaging the product slide and linearly moveable relative to the shelf and the product slide; and a plurality of locking mechanisms respectively connected to the product slides for maintaining the product slides in both displaying and stocking positions.

11. A display unit for use with a shelving system, the unit comprising:

a shelf adapted to cooperate with the shelving system; and a plurality of product trays supported by the shelf, each product tray comprising:

a product slide linearly moveable relative to the shelf; and a facing slide slidingly engaging the product slide and linearly moveable relative to the shelf and the product slide, wherein the facing slide comprises a push member extending into the product tray and a pull member connected to the push member, whereby pulling the pull member causes the push member to push a product in the product tray.

12. The unit of claim 7, comprising a plurality of shelves, including the shelf, each shelf comprising a plurality of product trays.

13. A shelving system comprising:

a support structure;

a plurality of shelves attached to the support structure;

a plurality of product trays connected to the shelves, each tray comprising:

a product slide moveable relative to the shelf, and a facing slide slidably engaged with the product slide and moveable relative to the shelf and the product slide; and a restoring spring connecting the product slide to the shelf and positioned to facilitate restoration of the product slide from a stocking position to a displaying position.

14. A display unit comprising:

means for containing products, the means being moveable relative to a support structure; and means for facing products, the means cooperatively engaging the means for containing products and being moveable relative to the means for containing products and the support structure to face products in the means for containing products and being fixable relative to the means for containing products while being movable relative to the support structure to facilitate restocking.

15. The display unit of claim 14, comprising means for restoring the means for containing products to a display position, the means for restoring connected to the means for containing products to bias the means for containing the products toward the display position.

16. The display unit of claim 5, comprising a restoring spring connected to the product member for facilitating return of the product member from a stocking position to a display position.

17. The display unit of claim 16, wherein the facing member comprises:

a push member projecting into the product member; and a pull member accessible from outside of the product member, wherein the pull member is connected to the push member, whereby pulling the pull member results in pushing a product in the product member with the push member.

* * * * *